US008925765B2

(12) United States Patent
Hanai et al.

(10) Patent No.: US 8,925,765 B2
(45) Date of Patent: Jan. 6, 2015

(54) ACTUATOR FOR AN AEROSOL CONTAINER

(75) Inventors: Nobuyuki Hanai, Tokyo (JP); Ken Ogata, Tokyo (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 5 days.

(21) Appl. No.: 13/811,484

(22) PCT Filed: Oct. 5, 2010

(86) PCT No.: PCT/JP2010/067407

§ 371 (c)(1),
(2), (4) Date: Jan. 22, 2013

(87) PCT Pub. No.: WO2012/017566

PCT Pub. Date: Feb. 9, 2012

(65) Prior Publication Data

US 2013/0119088 A1 May 16, 2013

(30) Foreign Application Priority Data

Aug. 3, 2010 (JP) ..... 2010-174321

(51) Int. Cl.

| | |
|---|---|
| ***B65D 83/34*** | (2006.01) |
| ***B05B 15/02*** | (2006.01) |
| ***B65D 83/16*** | (2006.01) |
| ***B65D 83/68*** | (2006.01) |

(52) U.S. Cl.

CPC ..... *B65D 83/34* (2013.01); *B05B 15/0216* (2013.01); *B65D 83/16* (2013.01); *B65D 83/68* (2013.01); *B05B 15/0225* (2013.01)

USPC ..... 222/137; 222/145.2; 222/151; 222/402.1

(58) Field of Classification Search

CPC . B05B 15/0216; B05B 15/0225; B65D 83/34

USPC ..... 222/137, 145.2, 145.1, 148, 151, 402.1; 239/114, 117, 123

See application file for complete search history.

(56) References Cited

U.S. PATENT DOCUMENTS

| | | | | | |
|---|---|---|---|---|---|
| 2,580,385 | A | * | 1/1952 | Hochmuth | 239/123 |
| 3,390,814 | A | * | 7/1968 | Creighton, Jr. et al. | 222/137 |
| 3,435,478 | A | * | 4/1969 | Moser | 15/104.095 |
| 4,801,465 | A | * | 1/1989 | Sponer | 426/116 |
| 5,040,728 | A | * | 8/1991 | Zwirlein et al. | 239/116 |
| 5,074,470 | A | * | 12/1991 | Rosenplanter et al. | 239/116 |
| 5,927,604 | A | * | 7/1999 | Laidler | 239/104 |
| 6,158,625 | A | * | 12/2000 | Siegel et al. | 222/148 |
| 6,516,972 | B1 | * | 2/2003 | Knestout | 222/151 |
| 2006/0219808 | A1 | * | 10/2006 | Woods | 239/123 |

* cited by examiner

*Primary Examiner* — Daniel R Shearer

(74) *Attorney, Agent, or Firm* — Florek & Endres PLLC

(57) ABSTRACT

A nozzle main body (42) which is formed with a plurality of independent communication flow paths (42*a*) each of which communicates with one of the stems is provided in the actuator main body. A scraping and washing member (43) is mounted on the communication flow paths in a manner to be pushed in and pulled out of the communication flow paths through the injection openings of the nozzle main body (42), said scraping and washing member (43) having a flow path portion (43*d*) formed with flow paths for contents liquids and a scraping portion (43*e*) for scraping out substance remaining after injection of the contents liquids. The scraping and washing member (43) is held by a holding member at a scraping and washing position where the scraping and washing member is pulled out of the communication flow paths.

4 Claims, 11 Drawing Sheets

DURING WASHING

A–A' SECTION

A–A' SECTION

ACTUATOR FOR AN AEROSOL CONTAINER

This application is a U.S. National Stage filing under 35 U.S.C. § 371 of International Application No. PCT/JP2010/067407, filed Oct. 5, 2010, which in turn claims priority to Japanese Patent Application No. 2010- 174321, filed Aug. 3, 2010.

TECHNICAL FIELD

This invention relates to an actuator for an aerosol container which, in a case where there is substance remaining in communication flow paths from stems after injection of contents liquids, is capable of scraping out such substance and washing the flow paths in a simple manner and thereby is capable of preventing blocking of an actuator which injects two contents liquids such as a creamy hair agent.

BACKGROUND ART

There are various types of aerosol products filled with contents liquids and a propellant. Among them, there are products according to which an excellent function can be obtained by mixing plural kinds of contents. Such products include, for example, coating, adherent, hair dye agent and pharmaceuticals.

Many of such substances which must be mixed before use cause chemical reaction such as hardening and oxidation by mixing and, therefore, when mixing is performed in an aerosol valve, there occurs a case wherein the aerosol valve cannot be reused due to hardening or the like cause. In such a case, therefore, it is preferable to dispense and inject such contents outside through an actuator instead of mixing them inside of the aerosol valve.

On the other hand, there is a contents liquid which causes blocking of an actuator due to drying after injection and in such a case, some measures must be taken to prevent this.

For this reason, Patent Literature 1 discloses a two-aerosol type liquid injection container in which a pair of aerosol containers are connected to each other by means of a coupling member which is fittedly connected to each of the containers. A first fitting cylinder suspending from a flow path member is fitted to stems of the aerosol containers and a second erecting fitting cylinder is also formed. A main cylinder member is detachably attached to the outside surface of the flow path member and the coupling member and a head with a nozzle and a cap having an operation lever are attached to the main cylinder member. In washing, the main cylinder member is detached from the coupling member and the flow path member is thereby detached from the stems. The flow path member is pulled out of the main cylinder member by means of a handling plate provided on the flow path member whereby remaining substance in the flow path can be washed off.

Patent Literatures 2 and 3 disclose a two-agent dispensing container in which a nozzle formed with a guide path is fitted to stems of two aerosol containers disposed side by side, a cover covering the nozzle is provided with an operation lever and this nozzle is detachably attached with the cover being attached to the nozzle. In washing, the nozzle is taken out and washed while the cover remains unwashed. A separately prepared nozzle washer is connected to the guide path of the nozzle and washing is made by sucking in and venting out fluid by operating a pomp portion.

PATENT LITERATURE

Patent Literature 1: Japanese Patent Application Laid-open Publication No. 2005-41510

Patent Literature 2: Japanese Patent Application Laid-open Publication No. 2003-20083

Patent Literature 3: Japanese Patent Application Laid-open Publication No. 11-59746

Problems to be Solved by the Invention

In the structure of Patent Literature 1 in which the flow path member is detached for washing, there is the problem that washing cannot be accomplished easily by simply pouring water on remaining substance which blocks the narrow flow path. There is also the problem that, although the handling plate is provided, the remaining substance adheres to the operator's hand when the flow path member is taken out.

When the nozzle washer having the pump portion which is disclosed in Patent Literatures 2 and 3 is used, the washer is soaked in water with the nozzle and the pump portion is operated to stretch and contract repeatedly for causing water to flow between the nozzle and the washer. In this case also, there is the problem that washing off of remaining substance which blocks the narrow flow path cannot be accomplished easily even by water pressure of the pump portion. Besides, the nozzle washer must be kept and stored separately from the dispensing container.

Further, in washing, the washer must be soaked in water with the nozzle and, therefore, the operator must put his hand into water in which the remaining substance is dissolved with the result that his hand is soiled. Furthermore, the process of washing until completion of the process is troublesome because it includes many processes of disassembling of the actuator, taking out of the nozzle, connection of the washer to the nozzle, soaking of the nozzle and the nozzle washer into water and reassembling of the actuator.

The present invention has been made for solving such problems of the prior art. It is an object of the present invention to provide an actuator for an aerosol container in which, when there is remaining substance after injection in a communication flow path from stems, such remaining substance can be scraped out and washing can be made easily.

Means for Solving the Problems

For solving the problems, an actuator for an aerosol container of claim 1 comprises: an actuator main body which is fixedly mounted on an aerosol container in a manner to enclose a plurality of stems of the aerosol container; a nozzle main body provided in the actuator main body which is formed with a plurality of independent communication flow paths each of which communicates with one of the stems and has an injection opening at one end and a fitting connection portion which is fitted and connected to the stem; a scraping and washing member which is mounted on the communication flow paths in a manner to be pushed in and pulled out of the communication flow paths through the injection openings, said scraping and washing member having a flow path portion formed with flow paths for contents liquids and a scraping portion for scraping out substance remaining after injection of the contents liquids; and holding means for holding the scraping and washing member at a scraping and washing position where the scraping and washing member is pulled out of the communication flow paths.

In an actuator of claim 2, in addition to the structure defined in claim 1, the nozzle main body is pivotably connected to the actuator main body by means of a hinge portion and the scraping and washing position where washing can be made is pivoted position of the nozzle main body.

In an actuator of claim 3, in addition to the structure defined in claim 1 or 2, the holding means for holding the scraping and washing member at the scraping and washing position comprises a holding arm and a stopping portion which stops the holding arm at the scraping and washing position.

In an actuator of claim 4, in addition to the structure defined in claim 3, the holding means for holding the scraping and washing member at the scraping and washing position comprises a holding arm and a stopping portion which stops the holding arm at a position where the contents liquids are injected.

In an actuator of claim 5, in addition to the structure defined in any of claims 1-4, the scraping and washing member has the flow path portion and the scraping portion in at least two portions of a lower end portion and a middle portion in such a manner that positions of the flow path portion and the scraping portion become respectively opposite between the two portions so that securing of the flow paths and scraping of the remaining substance can be simultaneously achieved.

In an actuator of claim 6, in addition to the structure defined in any of claims 1-4, the flow path portion and the scraping portion of the scraping and washing member are formed by forming a spiral projection on the scraping and washing member.

In an actuator of claim 7, in addition to the structure defined in any of claims 1-6, the aerosol container is an aerosol container having an inner diameter of 1 inch in which the plurality of stems are provided.

In this specification, "remaining substance" means not only remaining substance in liquid state of contents liquid filled in the aerosol container, but also remaining substance in jellified, foam-like or creamy contents liquid.

Advantageous Results of the Invention

According to the actuator for an aerosol container of claim 1, the actuator comprises: an actuator main body which is fixedly mounted on an aerosol container in a manner to enclose a plurality of stems of the aerosol container; a nozzle main body provided in the actuator main body which is formed with a plurality of independent communication flow paths each of which communicates with one of the stems and has an injection opening at one end and a fitting connection portion which is fitted and connected to the stem; a scraping and washing member which is mounted on the communication flow paths in a manner to be pushed in and pulled out of the communication flow paths through the injection openings, said scraping and washing member having a flow path portion formed with flow paths for contents liquids and a scraping portion for scraping out substance remaining after injection of the contents liquids; and holding means for holding the scraping and washing member at a scraping and washing position where the scraping and washing member is pulled out of the communication flow paths. By taking out the scraping and washing member from the injection opening of the nozzle main body and holding the scraping and washing member at a scraping and washing position by the holding means, remaining substance in the communication flow path can be scraped out by the scraping portion of the scraping and washing member and, by causing water to flow through a washing water flow path in the communication flow path where the remaining substance has been scraped out, the communication flow path can be washed easily as compared with a case in which the communication flow path is completely blocked. On the other hand, even in the state in which the scraping and washing member is inserted, a flow path can be secured by the flow path portion of the scraping and washing member whereby smooth injection of contents liquid can be ensured.

According to the actuator for an aerosol container of claim 2, the nozzle main body is pivotably connected to the actuator main body by means of a hinge portion and the scraping and washing position where washing can be made is pivoted position of the nozzle main body. Therefore, in washing, by pivoting the nozzle main body and the scraping and washing member to the scraping and washing position, washing by flowing water can be made even easily in a state in which the nozzle main body is located at a position which is different from the direction of the aerosol container.

According to the actuator for an aerosol container of claim 3, the holding means for holding the scraping and washing member at the scraping and washing position comprises a holding arm and a stopping portion which stops the holding arm at the scraping and washing position. Therefore, in washing, by stopping the holding arm at the stop portion, the scraping and washing member can be held at the scraping and washing position without removing it from the nozzle main body. Accordingly, the scraping and washing member will not be lost by flowing away during washing and reassembling can be made easily by merely pushing the scraping and washing member and the nozzle main body in the actuator.

According to the actuator for an aerosol container of claim 4, the holding means for holding the scraping and washing member at the scraping and washing position comprises a holding arm and a stopping portion which stops the holding arm at a position where the contents liquids are injected. Therefore, during injection, by stopping the holding arm at the stopping portion, the scraping and washing member can be held in position without being taken out due to injection and injection of contents liquid can be made in a stable state.

According to the actuator for an aerosol container of claim 5, the scraping and washing member has the flow path portion and the scraping portion in at least two portions of a lower end portion and a middle portion in such a manner that positions of the flow path portion and the scraping portion become respectively opposite between the two portions so that securing of the flow paths and scraping of the remaining substance can be simultaneously achieved. Therefore, by taking the opposite positions of the flow path portion and the scraping portion, flow paths can be secured at least in the flow path portion in the two portions where the flow path portion and the scraping portion assume opposite positions and injection can thereby be made through these flow paths while the remaining substance in the flow path portion in one of the two portions can be scraped off by the scraping portion in the other of the two portions.

According to the actuator for an aerosol container of claim 6, the flow path portion and the scraping portion of the scraping and washing member are formed by forming a spiral projection on the scraping and washing member. Therefore, the flow path can be secured and the remaining substance can be scraped off simultaneously by the spiral projection.

According to the actuator for an aerosol container of claim 7, the aerosol container is an aerosol container having an inner diameter of 1 inch in which the plurality of stems are provided. Therefore, by performing washing by using the scraping and washing member in the actuator provided in the aerosol container which is an aerosol container having an inner diameter of 1 inch in which the plurality of stems such as two stems are provided, a flow path can be secured and remaining substance can be scraped off simultaneously.

BRIEF DESCRIPTION OF THE DRAWINGS

FIGS. 1A and 1B are outside perspective views of an embodiment of the actuator for an aerosol container according to the invention in which FIG. 1A shows the actuator in an injection mode and FIG. 1B shows the actuator in a scraping and washing mode.

FIG. 9A is a front view of the scraping and washing state and FIG. 9B and FIG. 9C are partial sectional views of the scraping and washing state of the embodiment of the actuator.

EMBODIMENTS FOR CARRYING OUT THE INVENTION

Embodiments for carrying out the invention will now be described in detail.

In an embodiment of an actuator 1 for an aerosol container of the present invention, the actuator is mounted on a plurality of stems, e.g., two stems 15, 15, of an aerosol container 11. Contents liquids are distributed and injected from these stems 15, 15 without mixing together whereby remaining substance after injection in the actuator 1 can be washed off easily.

Figure 1A:
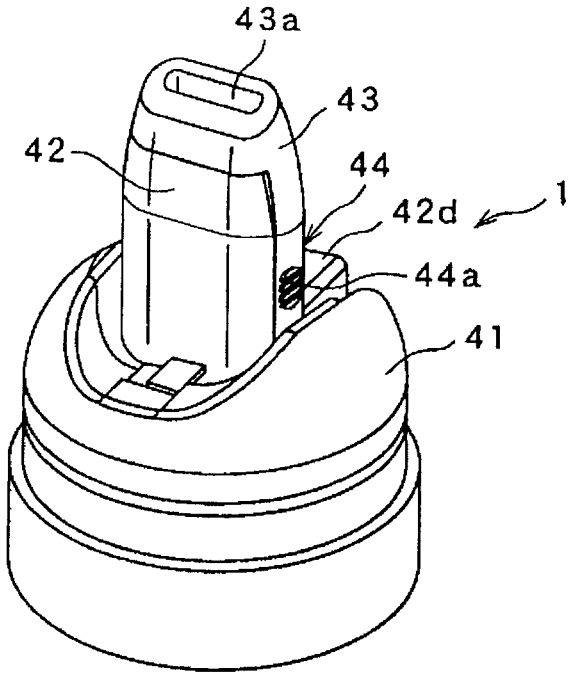
Figure 1B:
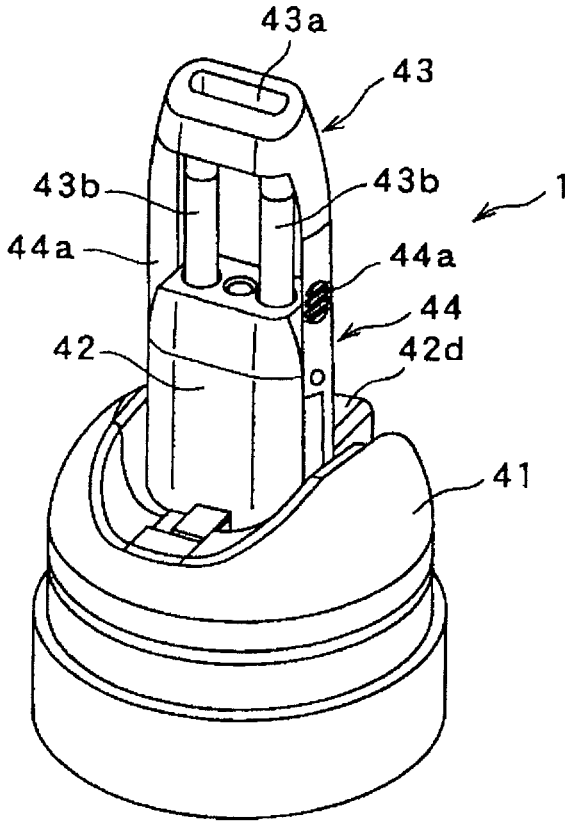
Figure 2:
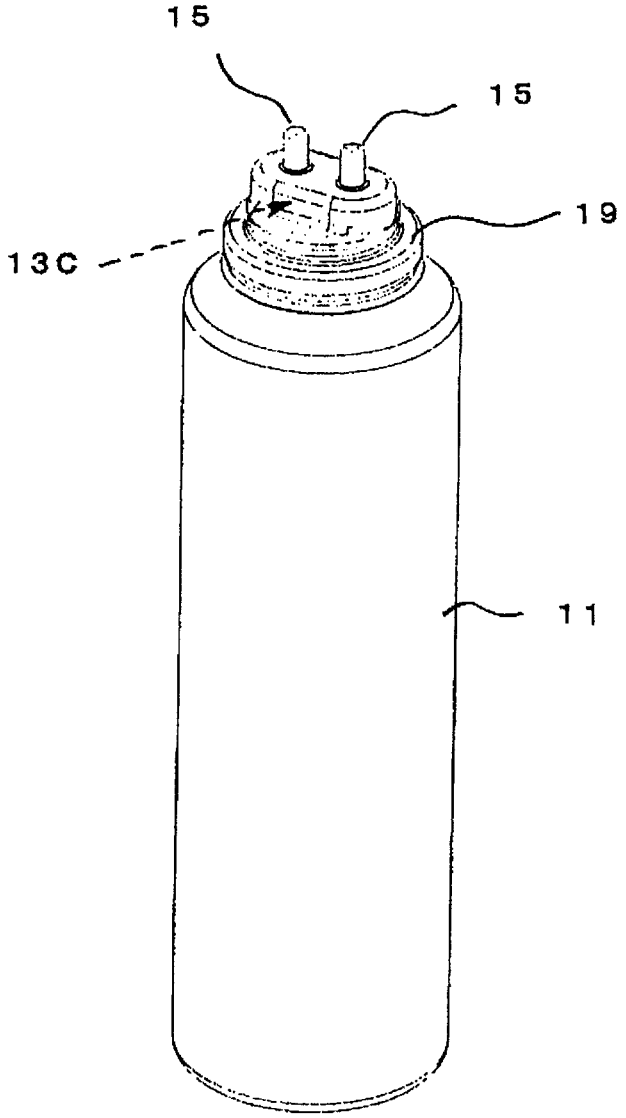
FIG. 2 is an outside perspective view of an example of an aerosol container to which the actuator for an aerosol container is applied.

Instead of the prior art actuator which is applied to aerosol containers disposed side by side and connected together by means of a connecting member, an aerosol container 11 to which the actuator 1 of the present invention is applied is, as shown in FIG. 2, a container having an inner diameter of 1 inch having a bead portion which is generally used as a standard type aerosol container. A pair of aerosol valves are provided in this aerosol container and the actuator 1 is applied to two stems 15, 15 of the aerosol valves.

Figure 3A:
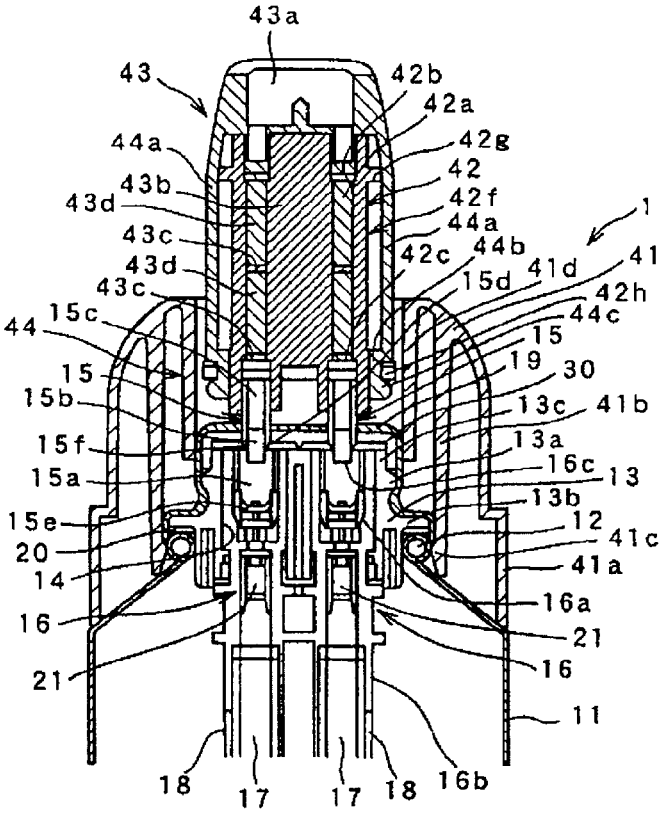
FIG. 3A is a center vertical sectional view (A-A' section in FIG. 4B
Figure 3B:
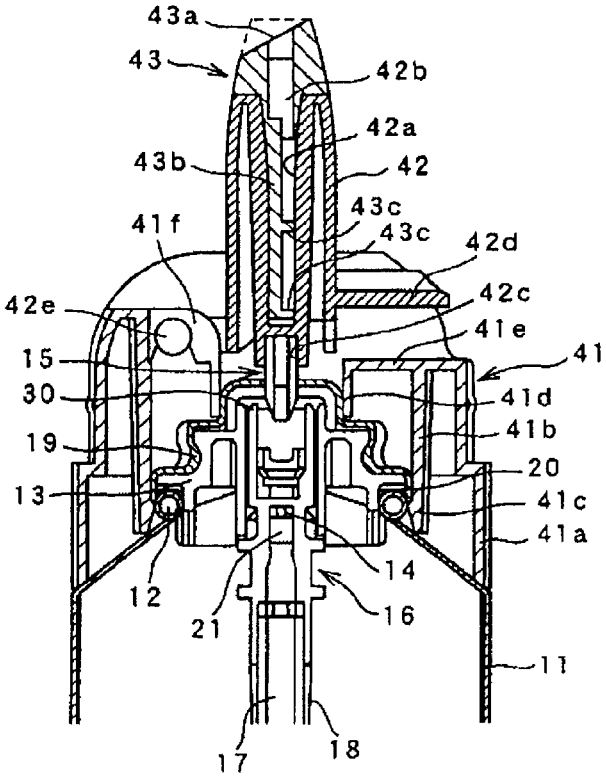
FIG. 3B is a B-B' sectional view in FIG. 4B respectively of the embodiment of the actuator.
Figure 4B:
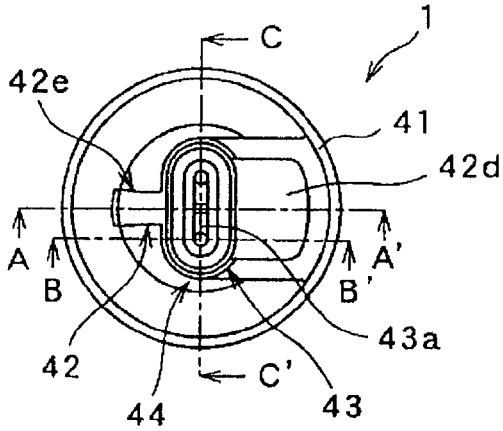
FIG. 4B is a plan view and FIG. 4C is a side elevation of the embodiment of the actuator.
Figure 4A:
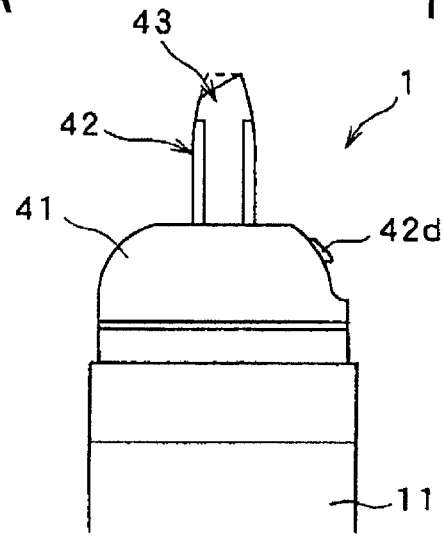
FIG. 4A is a front view.
Figure 4C:
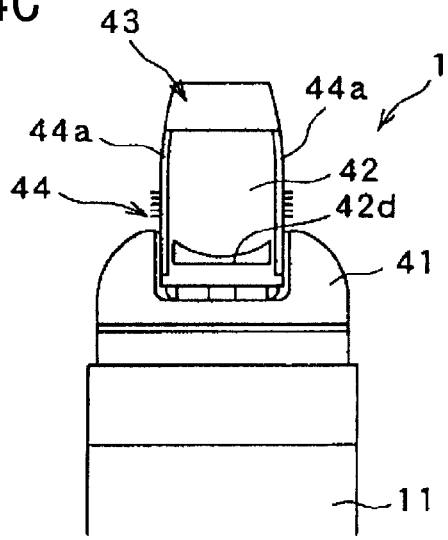

In the aerosol container 11 having the stems 15, 15 of the pair of aerosol valves, as shown in FIG. 3A, a mounting member 13 made of synthetic resin is fittedly mounted on a bead portion 12 of the aerosol container 11 and this mounting member 13 is formed with a pair of valve housing mounting portions 14, 14. The aerosol valves having the stems 15, 15 are mounted to the respective valve housing mounting portions 14, 14.

This mounting member 13 has a mounting member main body 13*a* having a generally cylindrical outside shape. A flange portion 13*b* is formed on the outer peripheral surface in the middle portion of the mounting member main body 13*a* in such a manner that it can abut against the upper surface of the bead portion 12 of the aerosol container 11. In the middle portion of the flange portion 13*b* are provided eight engaging pieces extending downwardly with an equal interval in the circumferential direction and each of the engaging pieces is formed with an engaging projection which can be engaged with the inner periphery of the bead portion 12. An interval between the upper end portion of each engaging piece and the mounting member main body 13*a* is supported by a radial rib extending in radial direction which is elastically deformable by a buffer space formed between the mounting main body 13*a*. By this arrangement, the mounting member 13 can be fittedly mounted on the bead portion 12 by pushing the mounting member 13 downwardly toward the bead portion 12 of the aerosol container 11.

The mounting member main body 13*a* of the mounting member 13 which is thus fittedly mounted on the bead portion 12 of the aerosol container 11 is provided with small, vertically parallel cylindrical valve housing mounting portions 14, 14 on both sides of the central axis of the mounting member 13. Two flat side walls projecting in the upper portion of the mounting member main body 13*a* are parallel to each other and a generally elliptical projecting end portion 13*c* is formed by these flat side walls and semicircular side walls between these flat side walls. The upper end portions of the valve housing mounting portions 14, 14 are disposed in the projecting end portion 13*c*.

Engaging pawls are formed in the inner peripheral portion of the middle portion of the valve housing mounting portions 14, 14. These engaging pawls engage with and thereby are fixed to stepped portions formed in the outer peripheral portion of the middle portion of the valve housing portions 14, 14 of the aerosol valve Each valve housing 16 is formed in the upper middle portion thereof with a valve chamber 16*a* and is formed in the lower end portion thereof with a tube connecting portion 16*b* to which a dip tube 17 is connected. An inner bag 18 which can vary its capacity by pressure of a propellant is attached to the outside surface of the tip tube 17.

In the aerosol valve which is mounted on each valve chamber 16*a*, a stem 15 is formed integrally with a stem body 15*a* and a stem projecting portion 15*b*. A injection path 15*c* is formed in the central portion of the stem projection. In a position in the injection path 15*c* corresponding to the upper surface of the stem body 15*a*, orifices 15*d* which communicate with the valve chamber 16*a* are opened in both sides of the injection path 15*c*. The stem 15 and the stem body 15*a* which is integrally formed with the stem 15 are energized upwardly by means of a spring 15*e* which is provided in the bottom portion of the valve chamber 16*a*.

Each stem 15 extends through a central opening of an annular stem gasket 15*f* which is closed and opened as a valve. In the state in which the stem 15 is energized upwardly to the upper end position which is a usual position of the stem 15, the stem 15 closes the orifices 15*d* opening on both sides of the stem 15 and thereby interrupts communication between the valve chamber 16*a* and the injection path 15*c*. When the stem 15 is pushed down, the stem gasket itself is bent and the orifices 15*d* thereby are opened to communicate the valve chamber 16*a* with the injection path 15*c* of the stem 15.

The stem gasket 15*f* which is opened and closed as a valve is disposed in such a manner that its peripheral portion covers the upper surface of the valve housing 16 and the upper surface of the projecting end portion 13*c* of the mounting member 13. A seal point is formed by an annular double concentric projecting portion which is provided on each of the upper surface of the valve housing 16 and the upper surface of the projecting end portion 13*c* of the mounting member 13 and, when the stem gasket 15*f* is pushed down, pressure on the surface is increased and sealing is thereby achieved. In this embodiment, the stem gasket 15*f* which is an integral body is used against the pair of stems 15, 15 and the stem gasket 15*f* has a shape corresponding to the shape of the upper surface of the generally elliptical projecting end portion 13*c*.

A cover 19 made of metal such as aluminum is provided in a manner to cover the mounting member 13 and the valve housings 16, 16. The stems 15, 15 project through the cover 19 and the cover 19 holds the stem gasket 15*f* and the outer peripheral portion of the lower portion of the cover 19 is fixed to the outside surface of the bead portion 12 of the aerosol container 11 by crimping.

Accordingly, the cover 19 has a configuration according to which the top portion of the cover 19 covers the outside of the generally elliptical projecting end portion 13*c* of the mounting member 13, a small cylindrical portion is formed below the top portion and a large cylindrical portion and a crimp portion are formed continuously below the small cylindrical portion. When the cover 19 is fixed to the bead portion 12, crimping is made with a seal gasket 20 being provided between the upper surface of the bead portion 12 and the flange portion 13*b* of the mounting member 13 whereby the aerosol container 11 is sealed with increased sealing property.

In this aerosol container 11 for dispensing a plurality of contents liquids, a lower valve chamber 16*d* is formed in s portion below the valve chamber 16*a* of each valve housing 16 and a poppet valve 21 is provided in the lower valve chamber 16*d* for smoothly conducting a filling process and adjusting an amount of injection. When contents liquid is filled, the poppet valve 21 is moved to a pushed down position to form a flow path around the poppet valve 21 so that contents liquid can be filled in a short period of time. In the state of use after the contents liquid has been filled, the poppet valve 21 is held at a position at which the poppet valve 21 is pushed up by the filled contents liquid whereby the amount of injection can be adjusted by a flow path formed in the central portion of the poppet valve 21.

Accordingly, when the poppet valve 21 is mounted, it is not necessary to control the amount of injection by the orifices 15*d* of the stem 15 so that the orifices 15*d* can be large holes which will not obstruct filling of contents liquid.

In this aerosol container 11, the cover 19 holds the single stem gasket 15*f* corresponding to the pair of stems 15, 15, Therefore, the area of the stem gasket 15*f* becomes large in proportion to the area of the projecting end portion 13*c* as compared with the conventional stem gasket corresponding to a single stem and, accordingly, a pressure receiving area to which inner pressure of the aerosol container 11 is applied becomes large.

Therefore, for holding the stem gasket 15*f* and preventing deformation of the cover 19, a reinforcing cover member 30 made of synthetic resin is provided in a manner to cover outside of the projecting end portion 13*c* of the mounting member 13. The stem gasket 15*f* is held and the deformation of the cover 19 is prevented by rigidity of this reinforcing cover 30 made of synthetic resin.

An actuator 1 for an aerosol container applied to the aerosol container 11 made of a container having an inner diameter of 1 inch and having the pair of stems 15, 15 comprises: an actuator main body 41 which is fixedly mounted on the aerosol container 11 in a manner to enclose the pair of stems 15, 15 of the aerosol container 11; a nozzle main body 42 provided in the actuator main body 41 which is formed with a pair of independent communication flow paths each of which communicates with one of the stems 15, 15 and has an injection opening at one end and a fitting connection portion which is fitted and connected to the stem 15; a scraping and washing member 43 which is mounted on the communication flow paths in a manner to be pushed in and pulled out of the communication flow paths through the injection openings, said scraping and washing member 43 having a flow path portion formed with flow paths for contents liquids and a scraping portion for scraping out substance remaining after injection of the contents liquids; and holding means 44 for holding the scraping and washing member 43 at a scraping and washing position where the scraping and washing member is pulled out of the communication flow paths.

By pulling out the scraping and washing member 43 from the injection openings of the nozzle main body 42 and holding the scraping and washing member 43 at the scraping and washing position, remaining substance in the communication flow path can be scraped off and by causing water to flow through a washing water flow path in the communication flow path where the remaining substance has been scraped out, the communication flow path can be washed easily as compared with a case in which the communication flow path is completely blocked.

On the other hand, even in the state in which the scraping and washing member 43 is inserted, a flow path can be secured by the flow path portion of the scraping and washing member 43 whereby smooth injection of contents liquid can be ensured.

This actuator main body 41 of actuator 1 constitutes a cover of the aerosol container 11 and has an upper portion which is formed in a dome shape and a cylindrical outer body portion 41*a* suspending from the upper portion and engaging with the upper end portion of the body portion of the aerosol container 11. Inside of the outer body portion 41*a*, there is formed a suspending middle body portion 41*b* in a manner to form double cylinders. An engaging pawl 41*c* which is formed projecting from the inner peripheral portion of the middle body portion 41*b* is engaged with the bead portion 12 whereby the actuator main body 11 is fittedly mounted on the aerosol container 11 in a manner to enclose the stems 15, 15 of the aerosol container 11.

Figure 5B:
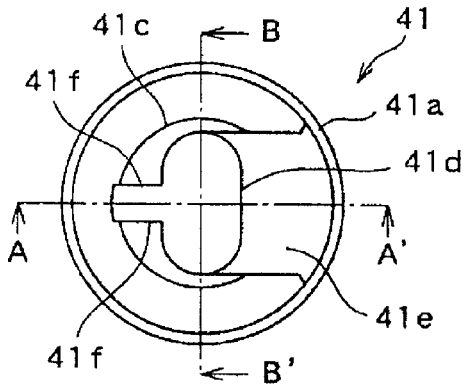
FIG. 5B is a plan view.
Figure 5A:
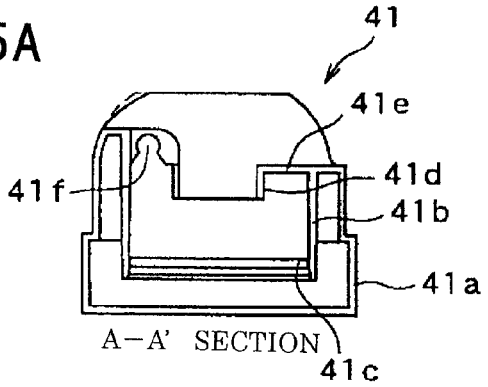
FIG. 5A is a center vertical sectional view.
Figure 5D:
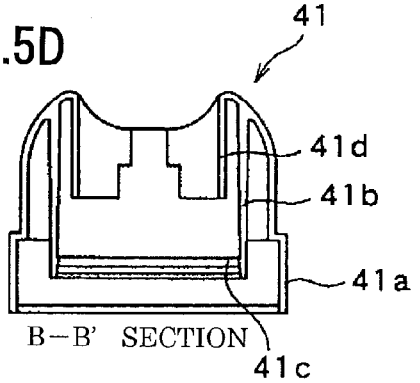
FIG. 5C is a bottom view and FIG. 5D is a side elevation of the actuator main body of the embodiment of actuator.
Figure 5C:
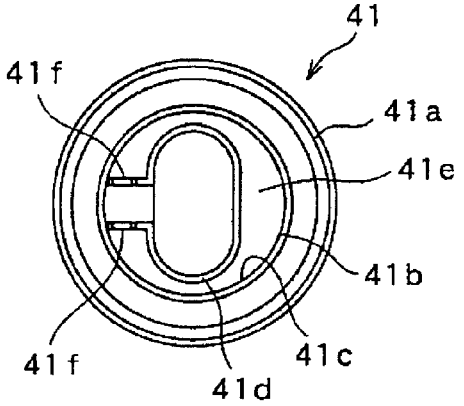
Figure 6B:
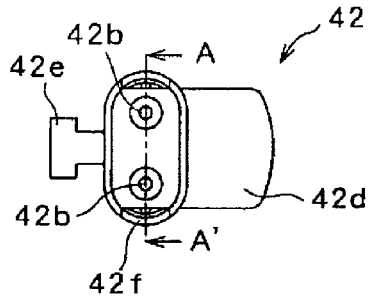
FIG. 6B is a plan view and FIG. 6C is a center vertical sectional view of the nozzle main body of the embodiment of the actuator.
Figure 6C:
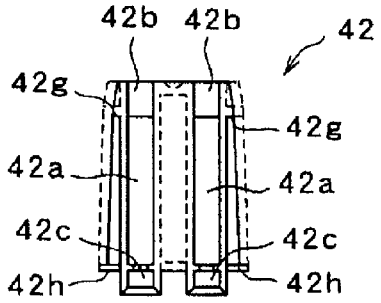
Figure 6A:
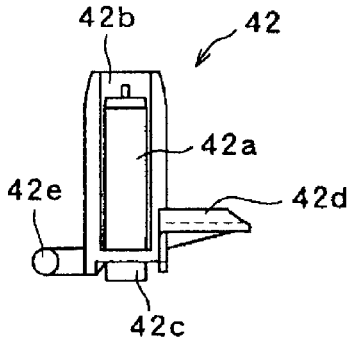
FIG. 6A is a front view.
Figure 7B:
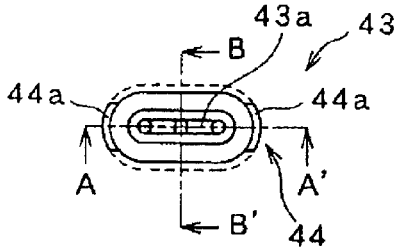
FIG. 7B is a plan view and FIG. 7C is a B-B' sectional view of the scraping and washing member of the embodiment of the actuator.
Figure 7A:
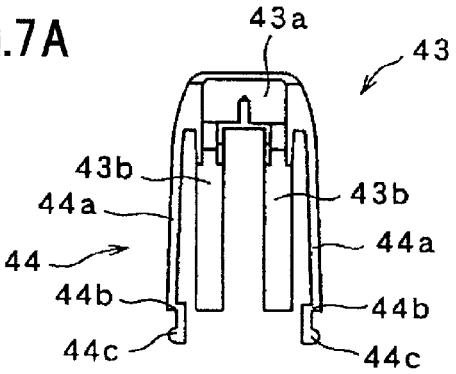
FIG. 7A is a center vertical sectional view.
Figure 7C:
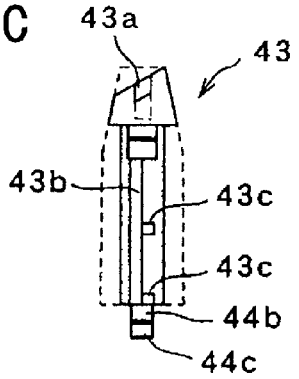

In the inside of the double cylindrical outer body portion 41*a* and the middle body portion 41*b* in the dome shaped upper portion of the actuator main body 41, there is formed a suspending inner body portion 41*d* having a shape corresponding to the outer peripheral portion of the elliptical projecting end portion 13*c* of the mounting member 13. The lower end portion of the inner body portion 41*d* contacts the outer peripheral portion of the cover 19. An operation side (right side in FIG. 5A) of the inner body portion 41*d* is formed as a low ceiling plate portion 41*e* which closes the upper ends of the middle body portion 41*b* and the outer body portion 41*a*. On the opposite side of the operation side, there are formed a pair of suspending parallel flat walls which constitute a pivoting support portion 41*f*.which opens downwardly.

The nozzle main body 42 which is mounted inside of the actuator main body 41 has a generally elliptical shape in its cross section and is formed therein a pair of cylindrical communication flow paths 42*a*, 42*a* communicating with the stems 15, 15. Upper end portions of the communication flow paths 42*a*, 42*a* constitute injection openings 42*b*, 42*b* and lower end portions of the communication flow paths 42*a*, 42*a* constitute fitting connection portions 42*c*, 42*c* for fitting with the stems 15, 15. On the operation side of the nozzle main body 42, an operation lever 42*d* is formed in a manner to project outwardly and is placed above the ceiling plate portion 41*e*. On the opposite side of the ceiling plate portion 41*e* is formed a horizontal pivoting shaft portion 42*e* which is supported by the pivoting support portion 41*f* of the actuator main body 41.

In the nozzle main body 42, guide grooves 42*f* for guiding insertion and pulling out of the scraping and washing member 43 is formed in outside portions on the major axis side. Stoppers 42*g* are formed in the upper portions of the guide grooves 42*f* for constituting stopping portions during washing. Stopping holes 42*h* are formed in the lower portions of the guide grooves 42*f* for constituting stopping portions during injection.

In the nozzle main body 42, the scraping and washing member 43 for scraping out remaining substance and performing washing is mounted in such a manner that it can be inserted into and pulled out of the injection openings 42*b*, 42*b*. This scraping and washing member 43 is formed in its ceiling portion with an injection opening 43*a* and also formed with a pair of scraping bar portions 43*b*, 43*b* which suspend from an upper partition portion of the injection hole 43*a* so that they can be inserted into and pulled out of the communication flow paths 42*a*, 42*a* of the nozzle main body 42. These pair of scraping bar portions 43*b* are located at the end of the communication flow paths 42*a*, 42*a*. Each scraping bar portion 43*b* is provided with horizontally projecting circular scraping plates 43*c* in the lower end portion and the middle portion of the scraping bar portion 43*b*. The lower end portion scraping plate 43*c* is formed with a recess in the central portion of the scraping plate 43*c* on the opposite side of the scraping bar portion 43*b* and this recess is used as a flow path portion 43*d* while the rest of the scraping plate 43*c* is used as a scraping portion 43*e*. The middle portion scraping plate 43*c* is formed, conversely to the lower end position scraping plate 43*c*, with a pair of recesses on both sides of the central projecting portion of the scraping plate 43*c* on the opposite side of the scraping bar portion 43*b* and these recesses are used as a flow path portion 43*d* while the rest of the scraping plate 43*c* is used as a scraping portion 43*e*.

By this arrangement, spaces above and below the middle portion scraping plate 43*c* and the flow path portions 43*d* formed by the recesses of the respective scraping plates 43*c* constitute a flow path during injection of contents liquids whereas remaining substance in the flow path in the middle portion can be scraped out by the scraping portion 43*e* of the lower end portion scraping plate 43*c* when remaining substance is scraped out by the scraping portions 43*e* of the scraping plates 43*c*.

According to the scraping and washing member 43, a flow path during washing can be secured and the pulled out portion of the scraping bar portion 43*b* can be used as a flow path during washing and, therefore, a flow path which extends continuously from the injection openings 43*a* at the upper end to the lower end portion can be secured.

The holding means 44 is provided for holding the scraping and washing member 43 at a scraping and washing position where the scraping and washing member 43 is pulled out of the nozzle main body 42. As the holding means 44, holding arms 44*a*, 44*a* are formed integrally with the ceiling portion of the scraping and washing member 43 made of synthetic resin in a manner to extend downwardly on both sides of the ceiling portion. The holding arms 44*a*, 44*a* can be contracted by elasticity of the synthetic resin by pushing them from both sides and can be expanded by releasing such pushing force. These holding arms 44*a*, 44*a* are formed in the lower end portions with L-shaped stepped portions 44*b*, 44*b* and also formed with engaging projections 44*c*, 44*c* which project outwardly.

By this arrangement, in the injection mode in which the scraping and washing member 43 is inserted in the nozzle main body 42, the engaging projections 44*c*, 44*c* of the holding arms 44*a*, 44*a* are inserted and engaged in engaging holes 42*h*, 42*h* formed in the lower portion of guide grooves 42*f*, 42*f* of the nozzle main body 42 whereby the injection mode can be secured. By pushing the holding arms 44*a*, 44*a* from both sides to contract, the holding arms 44*a*, 44*a* can be released from the engaged state and can be pulled out.

In the washing mode in which the scraping and washing member 43 is pulled out of the nozzle main body 42, the scraping and washing member 43 can be held at the scraping and washing position at which the scraping and washing member 43 cannot be pulled out any more by causing the stepped portions 44*b*, 44*b* to abut against stoppers 42*g*, 42*g* provided in the upper portion of the guide grooves 42*f*, 42*f*.

As shown in FIGS. 8A-8D, there are various forms of the flow path portion and the scraping portion formed in the scraping and washing member 43. In the form shown in FIG. 8B, the scraping bar portion 43*b* of the scraping and washing member 43 consists of left and right two bars and the scraping plates 43*c* are provided in the middle portion and the lower end portion of the scraping bar portion 43*b*. The scraping plate 43*c* in the lower end portion is formed with the flow path portion 43*d* in the form of a recess in the central portion and the portion other than the flow path portion 43*d* constitutes the scraping portion 43*e*. The scraping plate 43 in the middle portion is formed with the flow path portion 43*d* with two recesses on both sides of the central projecting portion and the portion other than the flow path portion 43*d* constitutes the scraping portion 43*e*.

By forming the flow path portion 43*d* and the scraping portion 43*a* of the scraping and washing member 43 at converse positions in the above described manner, a flow path can be secured by the conversely positioned flow path portions 43*d* while remaining substance in the flow path portion 43*d* in one portion can be scraped out by the scraping portion 43*e* of the other portion.

Figure 8A:
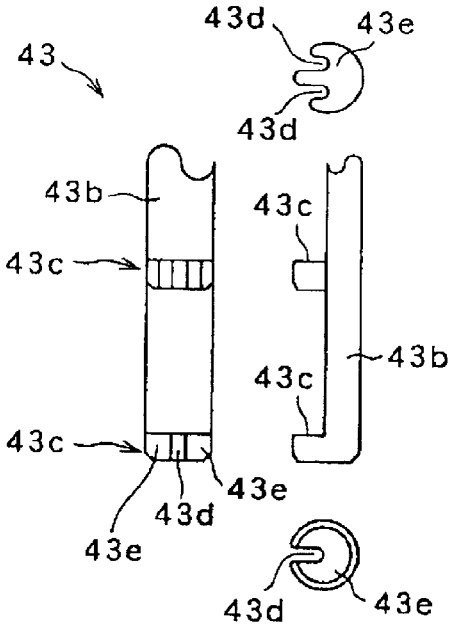
FIG. 8A is a front view.
Figure 8B:
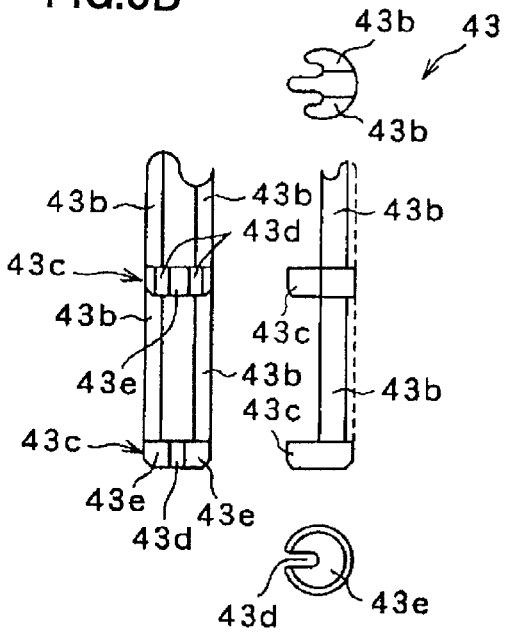
FIG. 8B is plan view.
Figure 8C:
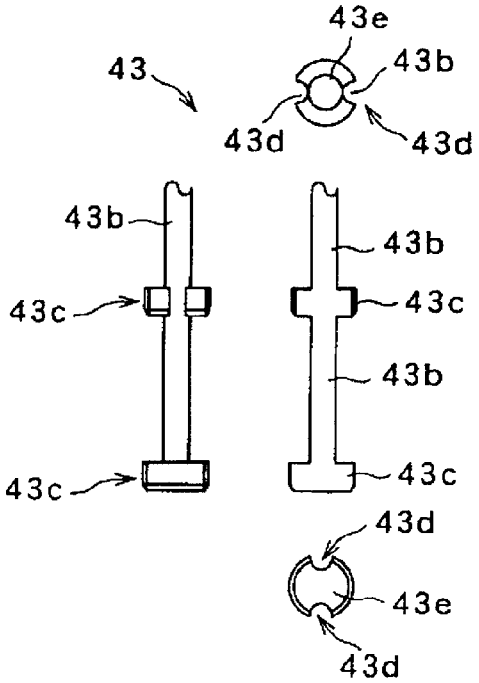
FIG. 8C is a bottom view and FIG. 8D is a side elevation of the flow portion and the scraping portion in the scraping and washing member of the embodiment of the actuator.

Alternatively, the flow path portion and the scraping portion of the scraping and washing member 43 may be formed as shown in FIG. 8C. In this example, the scraping bar potion 43*b* of the scraping and washing member 43 is positioned in the center of the scraping plates 43*c* and the scraping plates 43*c* are provided in the middle portion and the lower end portion of the scraping bar portion 43*b*. In the scraping plate 43*c* in the lower end portion, recesses constituting the flow path portion 43*d* are formed at diametrically opposed positions and the portion other than the flow path portion 43*d* constitutes the scraping portion 43*e*. In the scraping plate 43 in the middle portion, recesses constituting the flow path portion 43*d* are formed at diametrically opposed positions which are at right angles with the recesses of the flow path portion 43*d* in the lower end portion and the portion other than the flow path portion 43*d* constitutes the scraping portion 43*e*.

By forming the flow path portion 43*d* and the scraping portion 43*a* of the scraping and washing member 43 at converse positions in the above described manner, a flow path can be secured by the conversely positioned flow path portions 43*d* while remaining substance in the flow path portion 43*d* in one portion can be scraped out by the scraping portion 43*e* of the other portion.

Figure 8D:
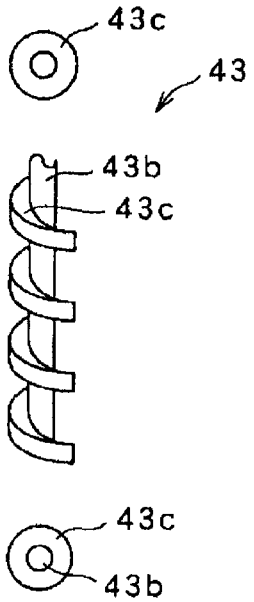
Figure 9A:
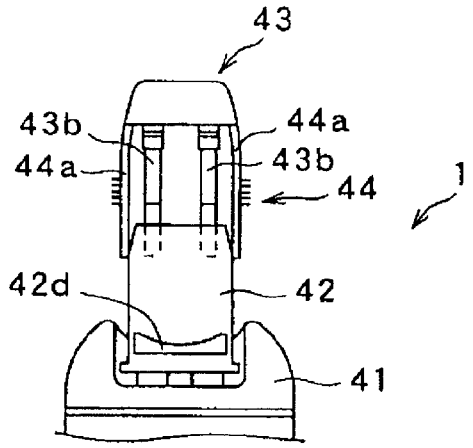
Figure 9B:
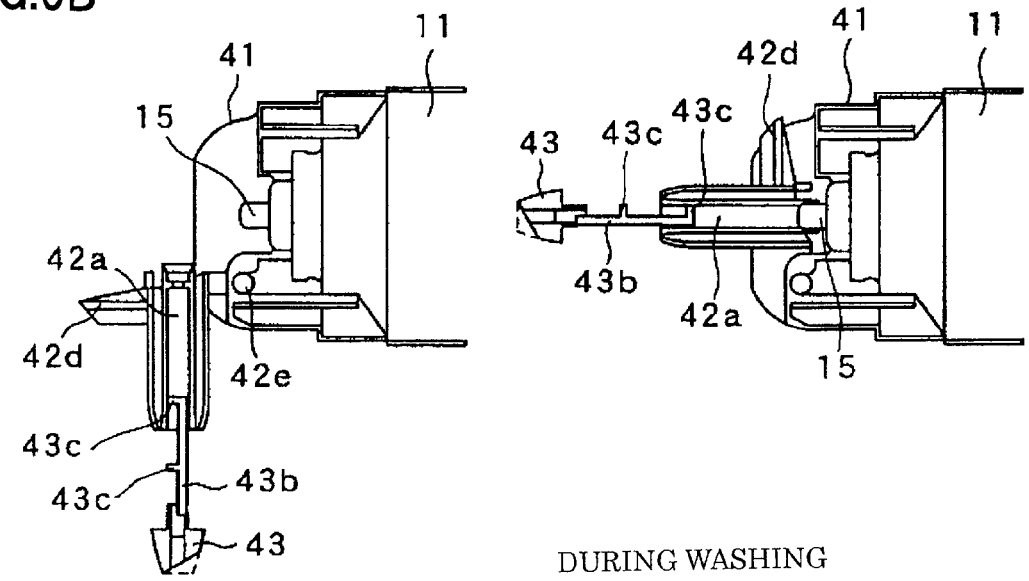

The flow path portion and the scraping portion of the scraping and washing member 43 may be formed as shown in FIG. 8D. In this example, the scraping bar portion 43*b* is disposed in the center and a spiral scraping plate 43*c* is provided around the scraping bar portion 43*b*. The flow path portion 43*d* is formed by space inside of the spiral of the spiral scraping plate 43*c* while the spiral portion 43*e* is formed by the spiral of the spiral scraping plate 43*c*.

By this scraping and washing member 43, a flow path can be secured by the space inside of the spiral scraping plate 43*c* and injection thereby can be achieved while remaining substance can be scraped out by the scraping plate 43*c*.

In the actuator 1 for an aerosol container, assembling, injection and washing of remaining substance are made in the following manner.

In assembling the actuator 1, the scraping and washing member 43 is inserted into the communication flow paths 42*a*, 42*a* of the nozzle main body 42 from the injection openings 42*b*, 42*b*. The engaging projections 44*c*, 44*c* of the holding arms 44*a*, 44*a* are put into the engaging holes 42*h*, 42*h* for engaging with the holes 42*h*, 42*h*. The pivoting shaft 42*e* of the nozzle main body 42 is mounted on the pivoting supporting portion 41*f* of the actuator main body 41 so that the nozzle main body 42 can be pivotably connected to the actuator main body 41 and the injection mode can be maintained.

In this state, the actuator main body 41 is disposed in a manner to enclose the pair of stems 15, 15 of the aerosol container 11 and the actuator main body 41 is mounted on the aerosol container 11 by fitting the engaging pawl 41*c* on the outer periphery of the bead portion 12.

For injecting contents liquids by this actuator main body 41, the operation lever 42*d* is pressed down in the state where the actuator main body 41 is mounted on the aerosol container 11. The pair of stems 15, 15 are thereby pressed whereby contents liquids can be injected in distributed state without mixing together through the injection paths 15*c*, 15*c* of the stems 15, 15, the communication flow paths 42*a*, 42*a* of the nozzle main body 42, the flow path portions 43*d*, 43*d* of the scraping and washing member 43, and the injection openings 43*a*, 43*a*.

Washing of the actuator 1 after injection is made in the following manner. First, for pulling out the scraping and washing member 43 from the nozzle main body 42 and scraping out remaining substance, the holding arms 44*a*, 44*a* of the holding means 44 are pushed inwardly from both sides and the engaging projections 44*c*, 44*c* at the engaging holes 42*h*, 42*h* are pulled out to release the engaged state.

Then, remaining substance is scraped out by the scraping plates 43*c*, 43*c* by pulling out the scraping and washing member 43 and the scraping and washing member 43 is held at the scraping and washing position which is the uppermost end position of the pulled out scraping and washing member 43 at which the stepped portions 44*b*, 44*b* of the holding arms 44*a*, 44*a* abut against the stoppers 42*g*, 42*g* of the nozzle main body 42.

Then, the nozzle main body 42 is pivoted about the pivoting shaft 42*e* to a position at which the nozzle main body 42 is inclined to the aerosol container 11 by about 90 degrees.

In the state in which the nozzle main body 42 is at a pivoted position, water is caused to flow from the fitting connection portion with the stems 15, 15 into the communication flow paths 42*a*, 42*a* of the nozzle main body 42 for washing the communication flow paths 42*a*, 42*a*. Simultaneously, the pulled out portion of the scraping and washing member 43 also is washed by the flowing water.

By scraping out remaining substance by the scraping and washing member 43 in this manner, flow paths are formed in the communication flow paths 42*a*, 42*a* of the nozzle main body 42. In the conventional actuator in which remaining substance blocks the communication flow path completely, there is often a case where flowing water is repelled by the blocking substance and fails to enter the communication flow path. According to the actuator 1 of the present invention, flowing water can be led to a washing flow path formed by scraping out remaining substance whereby washing can be made in a simple manner.

Further, according to this actuator 1, by holding the scraping and washing member 43 at the scraping and washing position by the holding means 44, loss of the scraping and washing member 43 by flowing water used in washing can be prevented. Neither is it necessary to store the scraping and washing member 43 for next washing. The scraping and washing member 43 can be re-assembled by pushing it into the nozzle main body 42 and, therefore, it is very easy to handle the scraping and washing member 43.

In the above described embodiment, the holding arms 44*a*, 44*a* as the holding means 44 are provided on both sides of the scraping and washing member 43. The holding means 44 is not limited to this structure but other structure may be used.

Figure 10A:
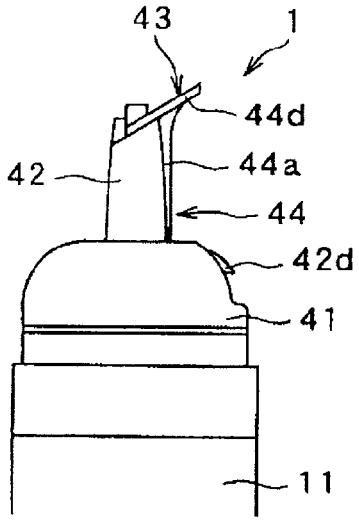
FIG. 10A is a front view.
Figure 10B:
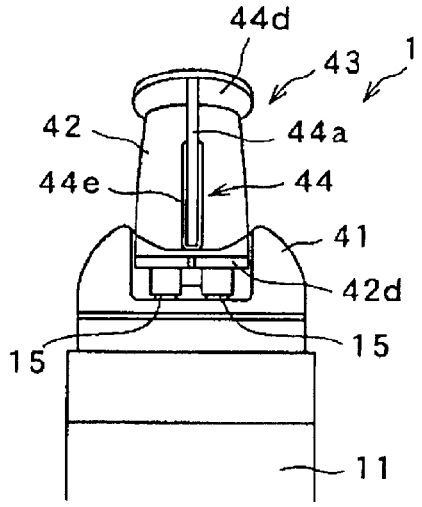
FIG. 10B is a side elevation and FIG. 10C is a center vertical sectional view of another embodiment of the actuator of the invention.
Figure 10C:
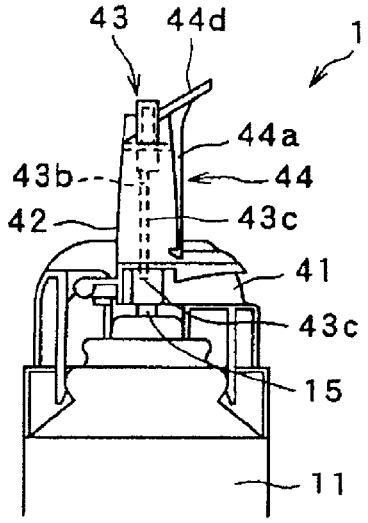
Figure 11A:
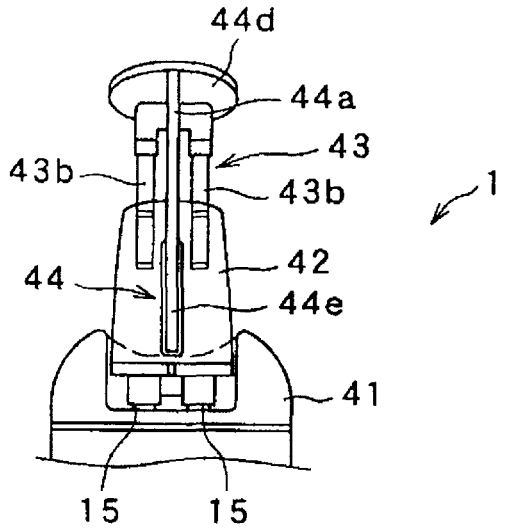
FIG. 11A is a front view and FIG. 11B is a partial sectional view of the scraping and washing state of the embodiment of the actuator.
Figure 11B:
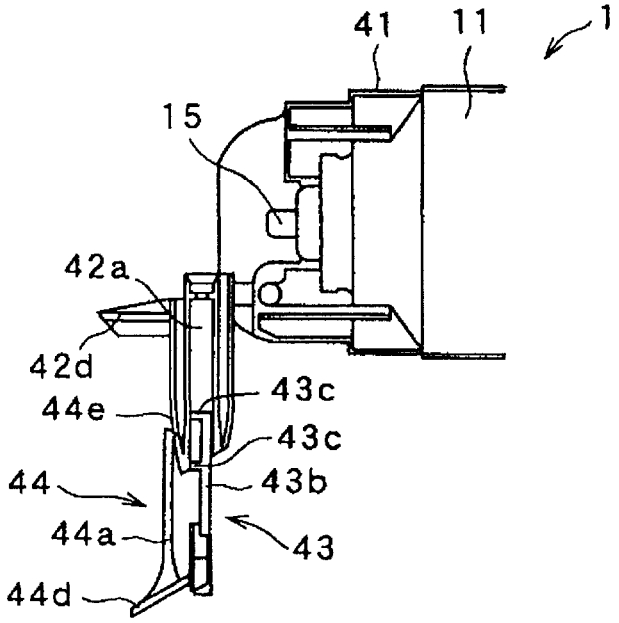

For example, the holding means 44 may be formed as shown in FIGS. 10A-10C. In this example, a single holding arm 44*a* is formed in the central portion on one side of the scraping and washing member 43, i.e., on the side of the operation lever 42*d*. A projecting operation lever 44*d* is integrally formed in the upper end portion of the holding arm 44*a* while an engaging projection 44*c* which projects inwardly is formed in the lower portion of the holding arm 44*a*. The nozzle main body 42 is formed with vertical engaging groove 44*e* in which the engaging projection 44*c* moves.

By this arrangement, by causing the engaging projection 44*c* of the holding arm 44*a* to engage in the upper end portion of the engaging groove 44*e*, the scraping and washing member 43 can be held at the scraping and washing position.

By this holding means 44 also, the scraping and washing member 43 can be held at the scraping and washing position. Loss of the scraping and washing member 43 by flowing water used in washing can be prevented. Neither is it necessary to store the scraping and washing member 43 for next washing. The scraping and washing member 43 can be re-assembled by pushing it into the nozzle main body 42 and, therefore, it is very easy to handle the scraping and washing member 43.

As contents liquids for which this actuator for an aerosol container is used can be cited a main agent and an additive of an aerosol product of a foam-like formulation which is not preferable for the reason that a chemical reaction such as hardening or oxidation takes place when the main agent and the additive are previously mixed together. This actuator is suitable for use for aerosol products such as hot shaving cream, hair dye, adherent, coating agent and pharmaceuticals. The actuator is particularly suitable for use for creamy contents liquids which tend to cause blocking due to drying.

DESCRIPTION OF REFERENCE CHARACTERS

1 actuator for an aerosol container
11 aerosol container having an inner diameter of 1 inch
12 bead portion
13 mounting member
13*a* mounting member main body
13*b* flange portion
13*c* projecting end portion
14 valve housing mounting portion
15 stem
15*a* stem body
15*b* stem projecting portion
15*c* injection flow path
15*d* orifice
15*e* spring
15*f* stem gasket

16 valve housing
16*a* valve chamber
16*b* tube mounting portion
16*c* seal point
16*d* lower valve chamber
17 dip tube
18 inner bag
19 cover
20 seal gasket
21 poppet valve
30 reinforcing cover member
41 actuator main body
41*a* outer body portion
41*b* middle body portion
41*c* engaging pawl
41*d* inner body portion
41*e* ceiling plate portion
41*f* pivoting supporting portion
42 nozzle main body
42*a* communication flow path
42*b* injection opening
42*c* fitting connection portion
42*d* operation lever
42*e* pivoting shaft
42*f* guide groove
42*g* stopper
42*h* engaging hole
43 scraping and washing member
43*a* injection opening
43*b* scraping bar portion
43*c* scraping plate
43*d* flow path portion
43*e* scraping portion
44 holding means
44*a* holding arm
44*b* stepped portion
44*c* engaging projection
44*d* operation portion
44*e* engaging portion

The invention claimed is:

1. An actuator for an aerosol container comprising:

an actuator main body which is fixedly mounted on the aerosol container in a manner to enclose a plurality of stems of the aerosol container;

a nozzle main body provided in the actuator main body which is formed with a plurality of independent communication flow paths each of which communicates with one of the stems and has an injection opening at one end and a fitting connection portion which is fitted and connected to the stem;

a scraping and washing member which is mounted on the communication flow paths in a manner to be pushed in and pulled out of the communication flow paths through the injection openings, said scraping and washing member having a flow path portion formed with flow paths for contents liquids and a scraping portion for scraping out substance remaining after injection of the contents liquids; and a holding member for holding the scraping and washing member at a scraping and washing position where the scraping and washing member is pulled out to a terminal position of the communication flow paths, wherein the holding member for holding the scraping and washing member at the scraping and washing position comprises a holding arm, the holding arm having a stopping portion which stops the holding arm at the scraping and washing position.

2. An actuator as defined in claim 1 wherein the nozzle main body is pivotably connected to the actuator main body by means of a hinge portion from an injecting position of contents liquids to the scraping and washing position.

3. An actuator as defined in claim 1 wherein the scraping and washing member has the flow path portion and the scraping portion in at least a lower end portion and a middle portion thereof in such a manner that positions of the flow path portion and the scraping portion alternate between one flow path flowing between outer scraping portions and two flow paths flowing around a scraping portion as the contents liquids move, so that securing of the flow paths and scraping of the remaining substance can be simultaneously achieved.

4. An actuator as defined in claim 1 wherein the flow path portion and the scraping portion of the scraping and washing member are formed by forming a spiral projection on the scraping and washing member.

* * * * *